United States Patent [19]

Snijders

[11] 4,013,173

[45] Mar. 22, 1977

[54] STAND INCLUDING MOVEABLE SUPPORTS FOR ACCOMMODATING ARTICLES OF DIFFERENT HEIGHTS AND DEPTHS

[75] Inventor: Willem Snijders, Tilburg, Netherlands

[73] Assignee: Snijders Metaalwarenfabriek B.V., Tilburg, Netherlands

[22] Filed: Feb. 24, 1975

[21] Appl. No.: 552,009

[52] U.S. Cl. ..... 211/126; 211/134; 248/235

[51] Int. Cl.[2] ..... A47F 3/14

[58] Field of Search ..... 211/79–81, 211/126, 133, 134, 150, 151, 71; 248/235, 240, 240.3, 240.4, 243, 242; 312/334, 351; 198/24, 107, 219

[56] References Cited

UNITED STATES PATENTS

| | | | |
|---|---|---|---|
| 2,612,272 | 9/1952 | Cobbs | 312/351 X |
| 2,936,077 | 5/1960 | Carpenter | 211/126 |
| 3,417,872 | 12/1968 | Close | 248/242 X |
| 3,531,169 | 9/1970 | Hoffman et al. | 312/236 |
| 3,591,015 | 7/1971 | D'Anka | 211/126 |
| 3,606,513 | 9/1971 | Hoffman et al. | 211/126 X |

FOREIGN PATENTS OR APPLICATIONS

| | | | |
|---|---|---|---|
| 271,788 | 6/1969 | Austria | 211/126 |
| 584,759 | 1/1947 | United Kingdom | 211/126 |

*Primary Examiner*—Lawrence J. Staab
*Attorney, Agent, or Firm*—Behr & Woodbridge

[57] ABSTRACT

An improved stand includes a frame, a plurality of supports and a means for allowing the supports to move transversely to the direction of insertion of an article into said stand. In this manner, articles higher than the support-to-support distance can be supported by one set of supports while not interfering with supports above or below the bearing support. According to the preferred embodiments, the supports are provided with a means to pivot or slide the supports out of the way of tall or deep articles. Supports are adapted to automatically return to their initial position after a tray or similar article has been removed from the stand.

6 Claims, 8 Drawing Figures

STAND INCLUDING MOVEABLE SUPPORTS FOR ACCOMMODATING ARTICLES OF DIFFERENT HEIGHTS AND DEPTHS

BACKGROUND OF THE INVENTION

1. Field of the Invention

The invention relates to a stand comprising supports arranged one above the other for supporting objects, for example, trays or the like, which can be slipped into and out of the stand across the supports.

2. Description of the Prior Art

With known stands of the kind set forth the supports are, in general, fixed in the stand at a given distance one above the other so that only objects having a given height can be inserted in between superjacent supports into the stand. Objects of different heights, therefore, require in general different stands.

SUMMARY OF THE INVENTION

The invention has for its object to provide a stand of the kind set forth, in which the height of the objects to be inserted into the stand is not limited by the distance between superjacent supports.

According to the invention this can be achieved by providing a displaceability of a support transverse of the direction of insertion of an object. It is thus possible to arrange a support in the stand, when an object of greater height than the distance between two superjacent supports, so that the support gets out of the range of movement of the object concerned and will, therefore, not hinder the insertion of the object.

The invention will be described more fully hereinafter with reference to a few embodiments of the construction in accordance with the invention shown in the accompanying drawings.

DETAILED DESCRIPTION OF THE INVENTION

Figure 1:
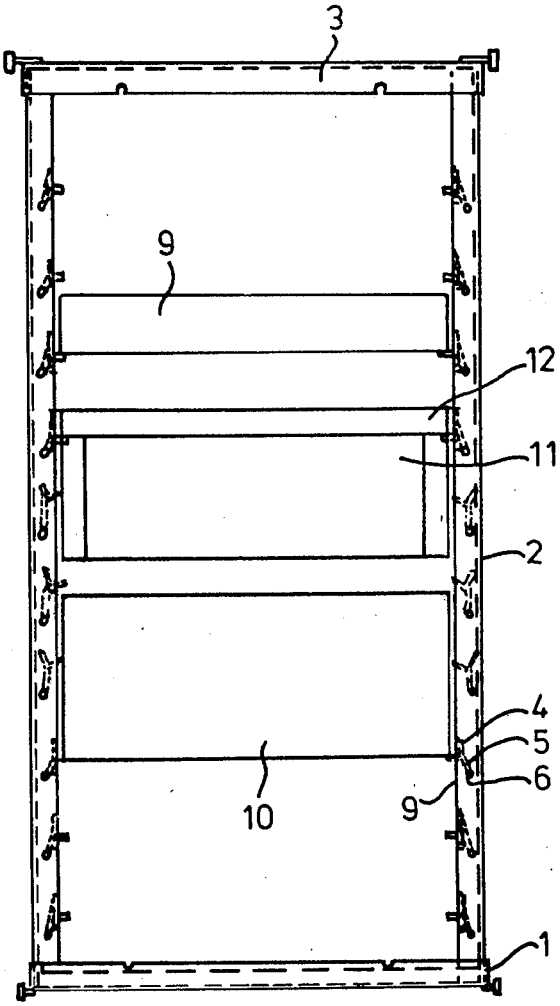
FIG. 1 is a front elevation of a stand embodying the invention.
Figure 2:
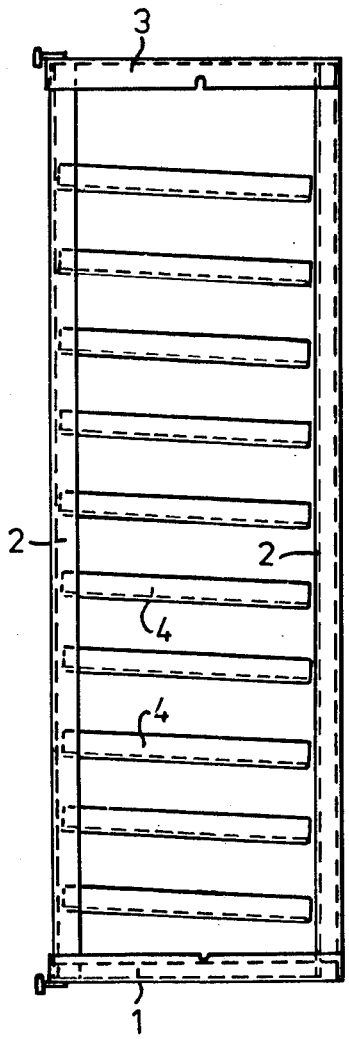
FIG. 2 is a side elevation of the stand shown in FIG. 1.

The stand shown in FIGS. 1 and 2 comprises a base frame 1, at the four corners of which angle-section irons 2 are erected in vertical position. The top ends of the angle-section irons 2 are interconnected by a similarly rectangular frame 3.

The Figures show furthermore that the supports are formed by angle-section irons 4 arranged between the upright angle-section irons 2. In the normal position suitable for holding an object one limb of the angle-section iron 4 is horizontal, whereas the other limb is in a vertical position, the horizontal limb extending away from its junction to the vertical limb towards the centre of the stand.

Figure 3:
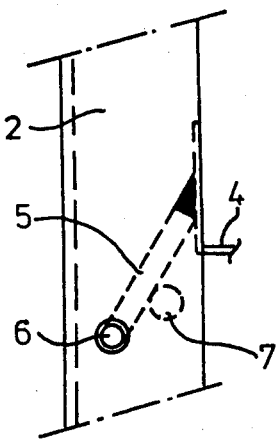
FIG. 3 shows on an enlarged scale part of an upright corner beam of the stand with the end of a support coupled herewith.

To the ends of each angle-section iron 4, to the vertical limb thereof, are fastened downwardly inclined bars 5, whose free ends 6 are bent over at right angles to the outside and rotatably journalled in holes provided in the vertical angle-section irons 2. A clockwise turn of the angle-section iron 4 out of the position shown in FIG. 3 is counter-acted by a pin 7, fastened to the angle-section iron 2 and forming a stop. As shown in FIG. 3, an anti-clockwise turn of the support formed by the angle-section iron is limited, since at such a turn the angle-section iron will come into contact with the limb of the angle-section iron 2 extending parallel to the direction of length of the angle-section iron 4. The structure is such that, when the angle-section iron 4 of FIG. 3 has turned to a maximum in anti-clockwise direction, the free edge of the limb of the angle-section iron occupying a horizontal position in FIG. 3 is located, as shown in FIG. 1, within the angle-section irons 2 holding the angle-section iron concerned. However, the centre of gravity of the angle-section iron 4 is still located on the right-hand side of the hinge pins 6 (see FIG. 3) so that when the angle-section iron is released in this position, it automatically drops back into the position shown in FIG. 3.

Figure 4:
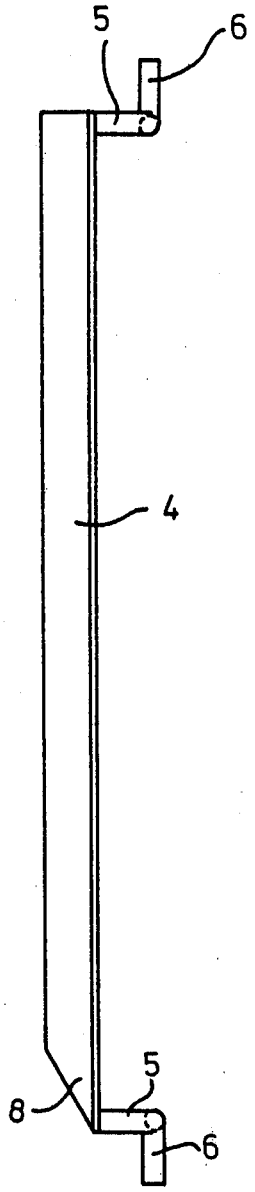
FIG. 4 is a plan view of a support employed in the stand.

FIG. 4 shows furthermore that the nomally horizontal limbs of the angle-section irons 4 have a bevelled portion 8.

FIG. 1 illustrates that an object, for example a tray or a drawer 9 can be slipped into the stand so that the drawer 9 bears on the relatively facing horizontal limbs of two opposite angle-section irons 4. The insertion of the drawer 9 can be performed without difficulty since the height of the drawer 9 is smaller than the distance between the superjacent supports 4.

FIG. 1 shows furthermore that a drawer having a height exceeding the distance between two superjacent supports can also be inserted into the stand. This is shown for a drawer or a tray 10, whose bottom side also bears on the horizontal limbs of two opposite angle-section irons 4 of the stand. When the drawer 10 is inserted, the sides thereof will come into contact with the bevelled sides 8 of the angle-section irons lying above the angle-section irons holding the drawer bottom 10 so that the angle-section irons are turned about the hinge shafts 6 of the angle-section irons concerned so that these angle-section irons are urged away transversely of the direction of insertion of the drawer 10 and will, therefore, not hinder the introduction of the drawer 10. In a similar manner a tray 11 having a lid 12 whose sides project out of the tray 11 can be slipped into the stand, so that the lid 12 with its projecting rims will lie on the horizontal limbs of the angle-section irons 4 and any angle-section irons located in the path of movement of the tray 11 are urged out of the path of movement of the tray 11 in the same manner as described above for the tray 10.

It will be obvious that, when the tray 10 or 11 is withdrawn from the stand, the angle-section irons 4 will swing back automatically into a position suitable for holding a tray or the like under the action of the force of gravity owing to the aforesaid position of the hinge axes 6 with respect to the centre of gravity of the angle-section irons in the turned position.

Figure 5:
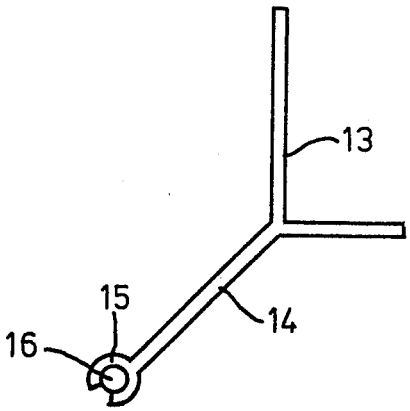
FIG. 5 is an elevational view of a second embodiment of a support suitable for use in a stand in accordance with the invention.

FIG. 5 shows a further embodiment of an angle-section iron 13, which is integral with a limb 14 inclinded downwards away from the corner of the angle-section iron, the free end of which limb has a C-shaped profile 15. This can be readily obtaind by extrusion and after the member has been cut to the desired length, pins 16 can be inserted into the ends of the profile 15 to form the pivotal shafts with the aid of which the supports can be pivotally journalled in the frame of the stand.

Figure 6:
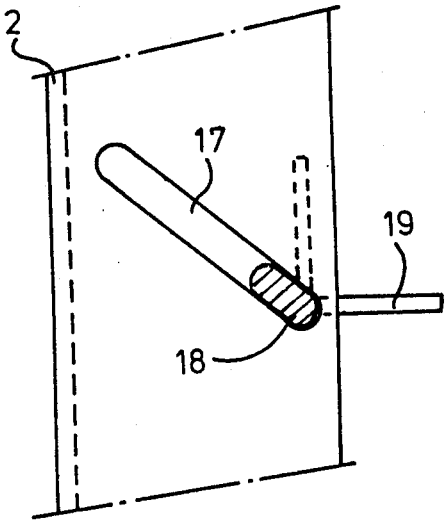
FIG. 6 is an elevational view like that of FIG. 3 of a further embodiment of a stand in accordance with the invention.

A further embodiment of a stand in accordance with the invention is shown schematically in FIG. 6. The vertical angle-section irons have elongated holes 17, whose longitudinal axes are at an angle to the horizontal. The elongated holes receive the ends of pins 18 fastened to the angle-section irons 19 forming supports. The ends of the pins 18 located in the elongated holes 17 have flattened sides so that the pins 18 cannot turn round in the elongated holes 17, but are displaceable in the direction of length of the elongated holes 17. It will be obvious that also in this embodiment the supports formed by the angle-section irons 19 are displaceable transversely of their direction of length and hence transversely of the direction of insertion of an object to be placed in the stand, the supports moving, in addition, in upward direction so that, when the force moving the supports outwardly disappears, they automatically slip back into the position shown in FIG. 6. A further possibility resides in the horizontal disposition of the elongated holes, in which case springs may be provided tending to hold the supports in a position suitable for holding an object, whilst the supports are displaceable outwardly transversely of their longitudinal direction against the action of said springs.

Figure 7:
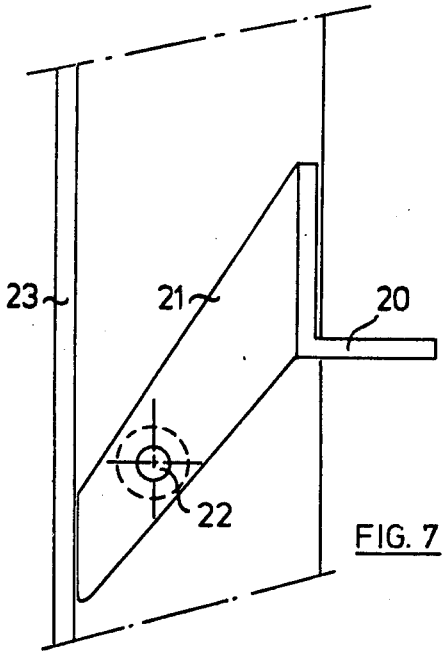
FIG. 7 shows a fourth embodiment for holding a displaceable support.
Figure 8:
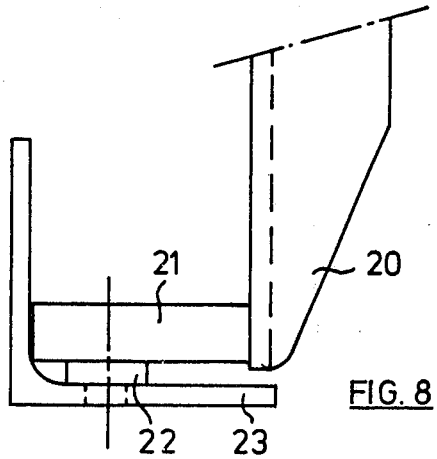
FIG. 8 is a plan view of the detail shown in FIG. 7.

In the embodiment shown in FIGS. 7 and 8 the ends of the angle-section irons 20 forming the supports are provided with shafts 21, which are integral with said angle-section irons and which are in contact with the side of the vertical limb remote from the horizontal limb so that these shafts are inclined downwardly as is shown in FIG. 7. The shafts 21 are pivoted by means of pins 22 to the angle-section irons 23 forming the vertical columns. The pins 22 are located at a lower level than the support 20 and the lower ends of the arms 21 extend as far as beneath the pins 22 so that these ends of the arms are each in contact with a flange of an adjacent angle-section iron 23 in order to prevent a clockwise turn of the support 20, viewed in FIG. 7. In this position the support is in a position suitable for holding an object. The support can furthermore turn about the pins 22 for movement transverse of the direction of insertion of an object into the stand. This movement is limited in that the top ends of the arms or the support come into contact with the flanges of the upright beams 23 extending parallel to the support so that the centre of gravity of the support 20 with the arms 21, viewed in FIG. 7, remains invariably on the right- hand side of the pins 22. When a support 20 is tilted up, it constantly tends to move back into the position shown in FIG. 7 under the action of its own weight, if it is not retained.

If desired, the stand may be provided with wheels or the like so that it can be readily displaced.

I claim:

1. A stand adapted to receive articles comprising:

a frame;

a plurality of support means adapted to support said articles and attached to said frame means, said support means including a tapered portion where said support means first makes contact with an inserted article, said tapered portion being such that when viewed in the direction of insertion of an article it gradually increases in width;

a pivotal shaft associated with said support means for displacing said support means transversely to the direction of insertion of an article into said stand, said pivotal shaft extending parallel to the direction of insertion of an article into said stand, and being pivotally received in the frame of said stand; and, stop means for limiting the rotation of said support means, wherein said support means tends to return to its original starting position after an article is removed from said stand.

2. The stand of claim 1 wherein said support means comprises an angle iron section.

3. The stand of claim 1 wherein the pivotal shaft is located at a level lower than the support means.

4. A stand adapted to receive articles comprising:

a frame;

a plurality of support means adapted to support said articles and attached to said frame means, said support means including a tapered portion, the tapered portion being located at that point where said support means first makes contact with an inserted article, said tapered portion further being such that when viewed in the direction of insertion of an article it gradually increases in width;

a pivotal shaft located at a lower level than said support means and associated with said support means for displacing said support means transversely of the direction of insertion of an article into said stand, said pivotal shaft extending parallel to the direction of insertion of an article into said stand and being pivotally received in the frame of said stand; and, stop means for limiting the rotation of said support means, said stop means being located at a level above said pivotal shaft, wherein said support means tends to return to its original starting position after an article is removed from said stand.

5. The stand of claim 4 wherein said support means comprises an angle iron section.

6. A stand adapted to receive articles comprising a frame having an interior and an exterior, said frame including a plurality of inclined slots situated therein, said inclined slots extending upwardly and outwardly from the interior toward the exterior of said frame;

a plurality of support means adapted to support said articles, said support means including a tapered portion, said tapered portion being located at that point where said support means first makes contact with an inserted article, said tapered portion further being such that when viewed in the direction of insertion of an article, it gradually increases in width;

means associated with said support means for displacing said support means transversely to the direction of insertion of an article into said stand, said means for displacing said support means comprising tab means attached to said support means and engagable in said outwardly and upwardly inclined slots, wherein said support means may be moved upwardly and outwardly from a starting position within said inclined slots by an inserted article and wherein the incline of said slots causes said support means to return downwardly and inwardly toward the starting position upon the removal of said articles.

* * * * *